US007082924B1

(12) United States Patent
Ruedin

(10) Patent No.: US 7,082,924 B1
(45) Date of Patent: Aug. 1, 2006

(54) INTERNAL COMBUSTION ENGINE SPEED CONTROL

(75) Inventor: Joshua C. Ruedin, Austin, TX (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 11/050,929

(22) Filed: Feb. 4, 2005

(51) Int. Cl.
*F02D 31/00* (2006.01)

(52) U.S. Cl. ..... 123/352; 123/355

(58) Field of Classification Search ..... 123/352, 123/353, 354, 355, 361, 399
See application file for complete search history.

(56) References Cited

U.S. PATENT DOCUMENTS

| | | | | |
|---|---|---|---|---|
| 4,082,158 | A | 4/1978 | Carol, Jr. et al. | |
| 4,173,205 | A | 11/1979 | Toelle | |
| 4,332,226 | A | 6/1982 | Nomura et al. | |
| 4,538,573 | A | 9/1985 | Merrick | |
| 5,889,204 | A | 3/1999 | Scherer et al. | |
| 6,715,476 | B1 | 4/2004 | Gopp et al. | |
| 6,728,625 | B1 | 4/2004 | Strubhar et al. | |
| 6,840,237 | B1 * | 1/2005 | Strom et al. | 123/684 |
| 6,945,221 | B1 * | 9/2005 | Baeuerle | 123/319 |
| 2004/0024518 | A1 | 2/2004 | Boley et al. | |
| 2004/0134462 | A1 * | 7/2004 | Strom et al. | 123/294 |
| 2004/0250801 | A1 * | 12/2004 | Baeuerle | 123/565 |
| 2005/0090966 | A1 * | 4/2005 | Strom et al. | 701/109 |

* cited by examiner

*Primary Examiner*—John T. Kwon
(74) *Attorney, Agent, or Firm*—Liell & McNeil

(57) ABSTRACT

A method of operating an internal combustion engine is provided which includes the step of determining a desired intake manifold pressure or gas density, based at least in part on a value indicative of a difference between a desired engine speed and an actual engine speed. The method further includes the steps of determining a value indicative of an intake manifold pressure, and adjusting the intake manifold pressure, based at least in part on a difference between the desired intake manifold pressure and the determined value indicative of intake manifold pressure. A software control algorithm for operating an internal combustion engine is provided. The control algorithm includes a first closed loop algorithm for determining a desired intake manifold pressure or gas density, and a second closed loop algorithm for adjusting throttle position, based at least in part on a difference between the desired intake manifold pressure or density and a determined value indicative thereof.

14 Claims, 2 Drawing Sheets

INTERNAL COMBUSTION ENGINE SPEED CONTROL

TECHNICAL FIELD

The present disclosure relates generally to speed control of internal combustion engines. More particularly, the present disclosure relates to engine speed control via closed loop manifold pressure or density control.

BACKGROUND

Internal combustion engines have long been used as power sources in a broad range of applications. For instance, since the development of electrical power and its widespread availability liquid fuel internal combustion engines have been widely used to power electrical generators. As with the burning of most fuels, however, certain gaseous and particulate pollutants can be problematic byproducts. In more recent years, gaseous fuel internal combustion engines have become commonplace, particularly in electrical power production operations. While many gaseous fuels inherently burn cleaner than liquid fuels such as gasoline and diesel, gaseous-fueled engines are not without emissions control problems. Moreover, increasingly stringent government regulations create a continuing challenge for engineers in designing and operating internal combustion engines that meet or exceed present and future standards for clean and efficient operation.

It is widely understood in the art that minimizing changes in engine speed can facilitate cleaner burning of the fuel, as well as improving operating efficiency. Moreover, many engines will have a particular speed or engine speed range associated with a desired level of performance. To this end, many engines are operated at or close to a predetermined engine speed set point. Where an internal combustion engine is coupled with an electrical generator, however, it has proven difficult to avoid unduly changing the engine's speed when a change in the electrical load on the generator occurs, for example, with relatively large increases or decreases in power demand on an associated electrical grid.

In certain engine designs an electronic controller adjusts the engine throttle upon detecting a load change or anticipated load change. Such designs often attempt to correlate throttle position with engine load and, in theory, will eventually adjust the intake manifold pressure to a point where the engine output torque suits the adjusted load. In many such designs, however, engine speed can fluctuate undesirably before settling, if at all, to within an acceptable range of the set point, due at least in part to rapidly changing intake manifold dynamics.

In particular, relatively rapid changes in the temperature and pressure of the gases in the intake manifold may briefly have a greater impact on engine torque output than changing throttle position. Such problems can be particularly acute where a turbocharger is coupled with the engine, imparting added complexity to the intake manifold dynamics. Where the engine torque output is not appropriate for the load, the imbalance may cause the engine to speed up or slow down, rather than settling toward a constant speed. Where intake manifold pressure and/or temperature are regularly or continuously fluctuating, the density of the gas mixture entering the engine cylinders may be changing, affecting the engine torque output and making it quite difficult to maintain the engine speed within a desirable range by adjusting throttle position. Adjustments in the throttle may be eclipsed by intake manifold dynamics.

Compounding the challenges presented by intake manifold dynamics, the relationship between throttle position and load tends to be difficult to predict. Engine speed and load, turbocharging, throttle position and intake manifold pressure and temperature may be cross-coupled variables, wherein a change in only one of the values may affect the others. In certain engine systems, for example, adjustment of throttle position or throttle angle will not necessarily relate linearly with the engine's output torque. In other words, increasing or decreasing throttle angle will not necessarily result in a corresponding increase or decrease in engine output torque. In some instances, an increase in throttle may be inversely proportional, at least temporarily, with engine output torque, particularly at higher engine speeds and loads and in highly turbocharged engines. Thus, in earlier designs an attempt to compensate for an increased load demand, for example, by opening the throttle could actually momentarily decrease the engine output torque, compounding speed control problems.

One example of an internal combustion system directed to intake manifold pressure control is described in U.S. Pat. No. 6,715,476 to Gopp et al. In Gopp et al, an engine is described having an exhaust gas recirculation system connecting with an intake manifold. An exhaust gas recirculation valve is adjusted to control intake manifold pressure, adjusting intake manifold pressure toward a desired pressure that is based on the position of an automatically controllable airflow actuator. The Gopp et al. design appears to have certain applications, for example controlling emissions, but does not appear well suited for controlling engine speed through adjustment of intake manifold pressure, as the disclosure is primarily concerned with increasing or decreasing the level of inert exhaust gas in the intake manifold.

The present disclosure is directed to one or more of the problems or shortcomings set forth above.

SUMMARY OF THE INVENTION

In one aspect, the present disclosure provides a method of operating an internal combustion engine. The method includes the steps of determining a value indicative of a difference between a desired engine speed and an actual engine speed, and determining at least one of, a desired intake manifold pressure and a desired intake manifold gas density, based at least in part on the value indicative of the difference between desired engine speed and actual engine speed. The method further includes the steps of determining a value indicative of an actual intake manifold pressure, and adjusting intake manifold pressure, based at least in part on the value indicative of actual intake manifold pressure and the at least one of, desired intake manifold pressure and desired intake manifold gas density.

In another aspect, the present disclosure provides an article including a computer readable medium having a control algorithm recorded thereon. The control algorithm includes a first closed loop control algorithm for determining one or both of a desired intake manifold pressure and a desired intake manifold gas density in an internal combustion engine, based at least in part on a value indicative of a difference between a desired engine speed and an actual engine speed. The control algorithm further includes a second closed loop control algorithm for controlling a throttle position in the engine based at least in part on, one or both of the desired pressure and density, and a determined value indicative of an actual intake manifold pressure.

DETAILED DESCRIPTION

Figure 1:
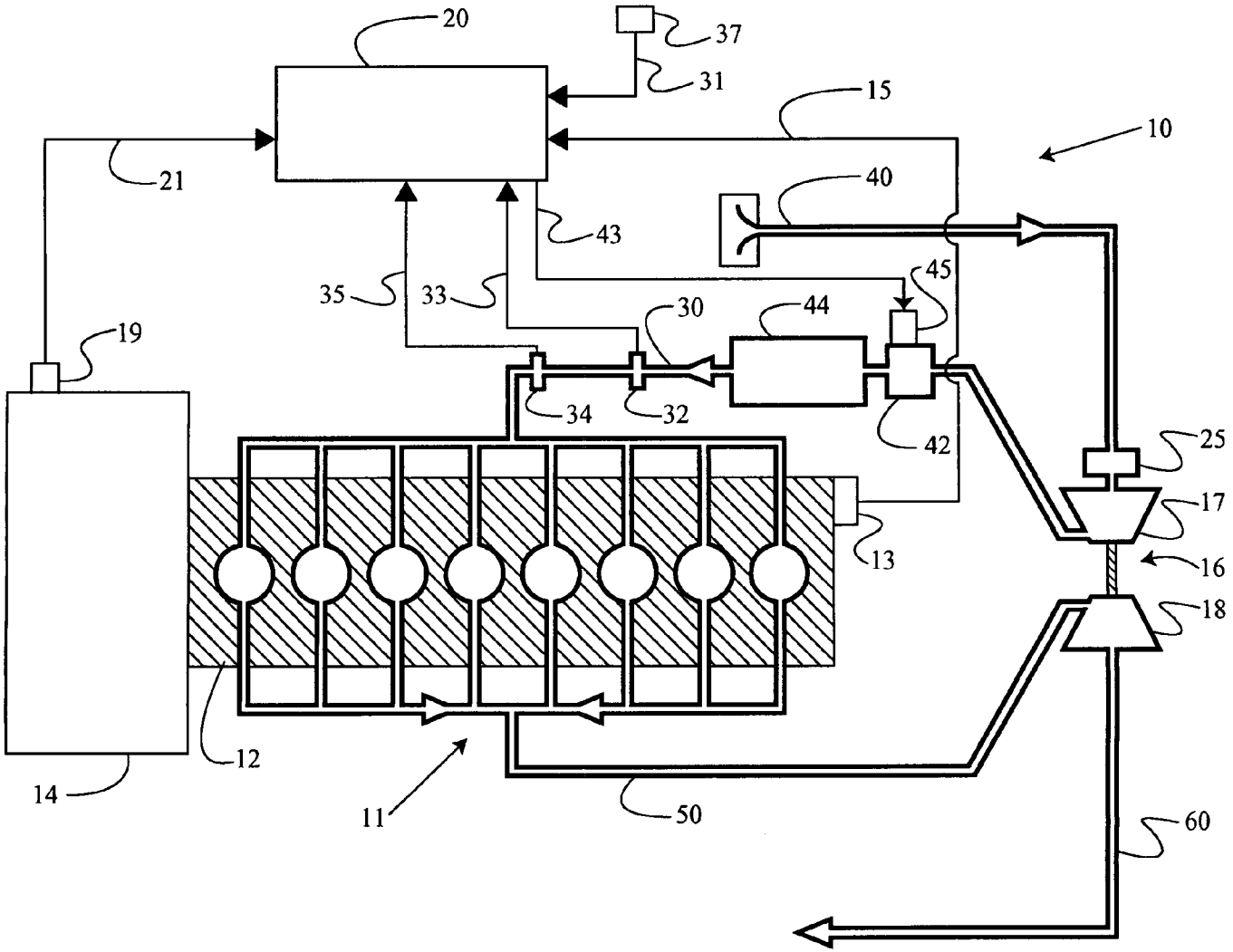
FIG. 1 is a diagrammatic view of an internal combustion engine having an electronic control system according to the present disclosure.

Referring to FIG. 1, there is shown an apparatus 10 that includes an internal combustion engine 11, typically a gaseous fuel spark-ignited engine, which may be coupled with an electrical generator 14. Engine 11 may include a conventional engine housing 12, an intake manifold 30 and an exhaust manifold 50. Engine 11 further may be coupled with a turbocharger 16 having a compressor 17 connecting with an air intake passage 40. Intake passage 40 may in turn connect with intake manifold 30 via a throttle body 42, and an aftercooler 44. Turbocharger 16 further includes a turbine 18 connecting with exhaust manifold 50 and an exhaust gas outlet passage 60. A fuel valve 25 will typically be positioned upstream compressor 17, however, those skilled in the art will appreciate that alternative designs are contemplated, for example, wherein fuel is direct injected or port injected into individual cylinders of engine housing 12, supplied to a combustion pre-chamber or even to a carburetor.

During operation, fresh air will typically flow into intake passage 40, then mix with a fuel such as a gaseous hydrocarbon fuel supplied at fuel valve 25. The fuel and air mixture will typically be compressed in compressor 17, then supplied to intake manifold 30 and engine housing 12. The quantity and pressure of the fuel and air mixture supplied to engine 11 may be varied by adjusting a throttle plate (not shown) in throttle body 42 with a throttle actuator 45. It is contemplated that engine 11 will typically operate with a gaseous fuel such as natural gas, methane, ethane, propane or any of a variety of other gaseous or gasified hydrocarbon fuels or fuel mixtures. For instance, a volatilized hydrocarbon fuel that is liquid at room temperature might be used in engine 11. Further, although it is contemplated that engine 11 will use a gaseous fuel, engine 11 might alternatively be a carbureted or fuel injected design.

Certain of the components of apparatus 10 may be electronically controlled. To this end, apparatus 10 may include an electronic controller 20. Electronic controller 20 may be in control communication via a communication line 43 with throttle actuator 45. Electronic control module 20 may further be coupled via another communication line 33 with an intake manifold pressure sensor 32 disposed at least partially within intake manifold 30, and via yet another communication line 35 with an intake manifold temperature sensor 34, also disposed at least partially within intake manifold 30. Electronic controller 20 will typically be operable to determine a valve indicative of actual intake manifold pressure and a valve indicative of actual intake manifold temperature, via its coupling with sensors 32 and 34, respectively.

Electronic controller 20 may further be coupled via another communication line 15 with an engine speed timing sensor, or speed sensor 13, many of which are known in the art. Engine speed sensor 13 might be, for example, mounted on an engine flywheel housing, and produce a signal in response to the speed of an engine flywheel interacting therewith. Alternatively, engine speed sensor 13 might be operably coupled with an engine crankshaft, a piston, or coupled with a valve or cam, for example. Those skilled in the art will appreciate that a broad suite of suitable devices and methods are available for determining a value indicative of a speed of engine 11, or difference between desired and actual speeds, as described herein.

An engine speed set point input 37 may be provided to allow an operator or another electronic controller, for example, to set or adjust an engine speed set point, by sending a control signal via a communication line 31 to electronic controller 20. Electronic controller 20 may further be coupled with a load sensor 19, which may be a conventional kilowatt sensor, coupled with generator 14 and operable to communicate a signal representing a load or change in load on engine 11 to electronic controller 20, via a communication line 21. Alternative types of load sensors are known in the art, and might include a torque sensor or dynamometer coupled with engine 11, rather than generator 14. It should further be appreciated that although it is contemplated engine 11 will typically be coupled with generator 14, engine 11 might instead operate as a stand alone device.

Electronic controller 20 will typically include a computer readable medium having a control algorithm recorded thereon. The control algorithm may include a first closed loop control algorithm for determining at least one of, a desired intake manifold pressure and a desired intake manifold gas density. The desired pressure or density, or both, may be based at least in part on a value indicative of a difference between a desired engine speed and an actual engine speed. Thus, the first closed loop control algorithm may determine, for example, a value indicative of the described speed difference or "speed error" by comparing a sensed speed of engine 11, via sensor 13, with an engine speed set point, determined for example from input 37. This value may then serve as the partial or sole basis for determining the desired intake manifold pressure or desired intake manifold gas density.

As used herein, the phrase "value indicative of" should be understood to encompass the characteristic or value of interest directly, e.g. a direct measure of intake manifold pressure or density, as well as other values having a known relationship with the characteristic or value of interest. "Value" itself should be understood to include a quantity, a code, and/or a signal. Discussions herein of a "signal" should in turn be similarly understood to refer broadly to communication of a variety of sorts between and among the various components of engine 11.

As described, either of desired intake manifold pressure or desired intake manifold gas density may be determined. A given intake manifold gas density, or "charge density" as it is known in the art, will generally be directly proportional to a given engine load. Density is in turn related to gas pressure and temperature in the intake manifold, in a manner well understood in the art. As described herein, in the present disclosure adjustment of intake manifold gas density may be used to adjust engine torque output to a level appropriate for a given load. By providing an appropriate intake manifold gas density, the engine will be outputting a torque that sufficiently matches the load demands on the engine such that engine speed may be adequately controlled.

In many applications, however, intake manifold pressure alone may correlate sufficiently with load such that temperature fluctuations need not be considered, as the range of temperature fluctuations encountered will typically be relatively narrower than the range of pressure fluctuations during normal operation. Because density is related to both pressure and temperature, the net effect on charge density of pressure variation may be larger than the effect resulting from temperature variation, under normal operating conditions. Nevertheless, because temperature changes will have some effect on charge density, optimal performance will typically be attained where both of intake manifold pressure and temperature are considered. In certain applications, for instance in retrofit systems already having a pressure sensor but no temperature sensor, it may be desirable to forego temperature measurement and the resultant density calculation, utilizing pressure alone.

In arriving at the desired intake manifold pressure or gas density, electronic controller 20 may utilize a look-up table, for example, having values for desired intake manifold pressures or densities that correspond with particular speed error values. The use of equations, neural networks and the like instead of a look-up table is also contemplated. In general terms, a negative speed error value, i.e. where engine 11 is slower than desired, may call for a relative increase in intake manifold pressure or gas density, whereas conversely a positive speed error value may call for a relative decrease in intake manifold pressure or density. It should be appreciated, however, that the relationship between speed error and desired intake manifold pressure or density may not necessarily be linear, nor follow the speed error relationship just described. In some instances, inversely proportional relationships between speed error and intake manifold pressure may exist, across a portion of the speed and load ranges. Further, the relationship may be different at lower speeds and loads than at higher speeds and loads. Where a look-up table is utilized, it may be populated experimentally for each individual engine apparatus 10, however, the look-up table values might also be generated from one or a small number of test engines, and applied broadly to a group of similar engine apparatuses. It is contemplated that in the latter case, the ability to use broadly applicable values, will be one advantage of an engine designed and operated according to the present disclosure.

Returning to the first closed loop control algorithm, the algorithm may further include a feed forward term based on a change in the load on engine 11, for example, communicated to electronic controller 20 from sensor 19. Thus, when a change in engine load is detected, for example, due to a change in power demand on an electrical grid coupled with generator 14, a feed forward signal including a value indicative of or approximating the change in load can be communicated to electronic controller 20. For example, where engine 11 is operating at or close to a constant speed, and an increase in power demand or a transient is detected by sensor 19, a signal may be sent to electronic controller 20 such that the desired intake manifold pressure may be determined in conjunction with the actual engine load. Intake manifold pressure may then be adjusted open loop in advance, possibly without any substantial slowing or speeding up of engine 11.

The control algorithm of electronic controller 20 may further include a second closed loop control algorithm for adjusting a throttle position in engine 11 based at least in part on the desired intake manifold pressure or density, and a determined value indicative of the intake manifold pressure. More particularly, electronic controller 20 may, via the second closed loop control algorithm, adjust intake manifold pressure based at least in part on a difference between the value indicative of intake manifold pressure, and the desired intake manifold pressure or density, referred to generally herein as "pressure error." Thus, the second closed loop control algorithm may determine, for example, the described difference by comparing a sensed pressure or gas density in intake manifold 30 with the desired intake manifold pressure or gas density determined in the first closed loop control algorithm. The determined pressure error may then serve as the partial or sole basis for a control command to throttle actuator 45 to adjust the intake manifold pressure toward the desired intake manifold pressure.

As described herein, the relationship between throttle position and intake manifold pressure and density may be relatively complex, non-linear and even inversely proportional, particularly at relatively higher speeds and loads. In determining the appropriate throttle adjustment, for example throttle position or rate of change in throttle position, electronic controller 30 may utilize a look-up table populated with predetermined throttle position or rate of change in throttle position values corresponding to determined pressure error values. Similar to the values accessed by the first closed loop control algorithm, the look-up table utilized by electronic controller 20 in the second closed loop control algorithm may be populated experimentally for each engine, or values broadly applied to a class of engines based on one or more test units. Other strategies besides look-up tables may be utilized, such as equations, neural networks and the like.

The second closed loop control algorithm may adjust throttle position in engine 11 based on either a desired intake manifold pressure or a desired intake manifold gas density, either or both of which may be determined in the first closed loop control algorithm. Where intake manifold gas density is the factor of interest, electronic controller 20 may determine a value indicative of the gas density by calculating a ratio of sensed intake manifold pressure to sensed intake manifold temperature. The relative degrees of importance in the particular engine system of changes in pressure and/or temperature in the intake manifold may determine whether pressure alone, or density based on both pressure and temperature will be the factor of interest.

Where intake manifold gas density is of concern, rather than intake manifold pressure alone, the actual density of the gas mixture can be measured, approximated or estimated by any of several means. A form of the ideal gas equation may be utilized to facilitate a calculation of the intake manifold gas density, which is as follows:

$$d = \frac{P(MW)}{RT}$$

where:

d=gas or gas mixture density;

P=gas or gas mixture pressure;

T=gas or gas mixture temperature;

R=Ideal Gas Constant.

MW=average molecular weight of the gas or gas mixture

Measuring the ratio of pressure to temperature, or the inverse thereof, of the gases in intake manifold 30 allows a calculation of the density of the gas entering the cylinders of engine housing 12. This capability exists irrespective of the gaseous fuel type. In particular, because "R" is a constant, it represents a known value. Likewise, "MW", or average molecular weight relates to known gases, namely air and typically gaseous fuel, entering intake manifold 30, and thus also represents a known value. Accordingly, a ratio of "P" to "T" can be correlated with and is in fact a value indicative of, a density of the combustion mixture. Likewise, a calculation of the value indicative of density, or a calculation of density itself, is a value indicative of intake manifold gas pressure.

Figure 2:
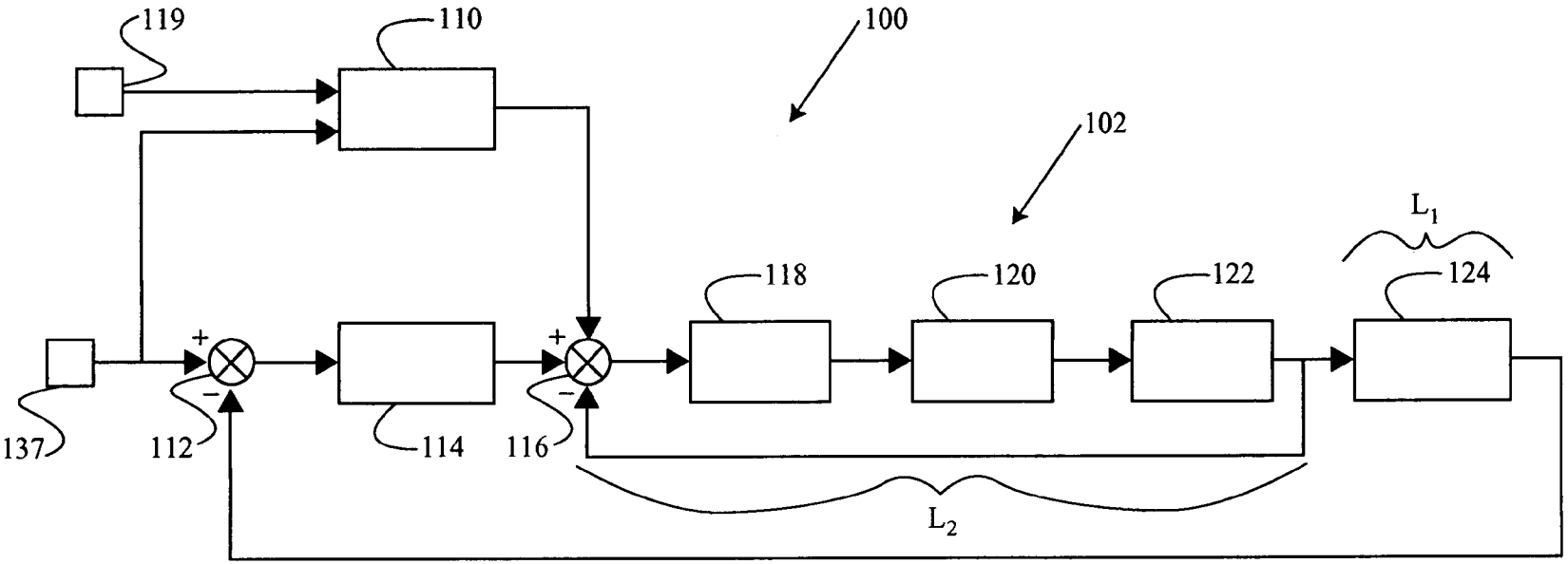
FIG. 2 is a schematic illustration of dual engine control loops in an internal combustion engine control system according to the present disclosure.

Referring also to FIG. 2, there is shown schematically an engine speed control system 100 according to the present disclosure. Control system 100 includes an outer control loop $L_1$, representing the first closed loop control algorithm described herein, and an inner control loop $L_2$ representing the second closed loop control algorithm described herein. Those skilled in the art will appreciate that while a single electronic controller may be programmed such that it can execute all of the control functions described herein, multiple controllers might be utilized without departing from the scope of the present disclosure. Moreover, the respective controller 20 may include any suitable computer readable medium, and the control algorithm(s) described herein may be recorded in ROM, RAM or another medium.

$L_1$, or the first closed loop control algorithm may be a relatively slower control loop, for example, less than about one cycle per second, whereas $L_2$, or the second closed loop control algorithm, may be a relatively faster control loop, for example, between about three and about four cycles per second. Actual loop speed of the respective control loops may vary, however, and the present disclosure should not be thereby limited. $L_1$ may include determination of the desired intake manifold pressure or density, based at least in part on the described value indicative of the difference between actual engine speed and desired engine speed. $L_2$ may adjust throttle position in engine 11, based at least in part on a value indicative of the difference between desired intake manifold pressure or density, and the value indicative of intake manifold pressure. As described herein, intake manifold gas density may be a value indicative of intake manifold pressure. Accordingly, the description herein of the value indicative of intake manifold pressure should be understood to include values arrived at by calculating, estimating or inferring pressure, and also values arrived at by calculating, estimating or inferring gas density.

The relatively faster loop speed of $L_2$ may result in adjustment of intake manifold pressure, for example via adjustment of throttle actuator 45, multiple times during each determination of desired intake manifold pressure/density. In other words, for each time that $L_1$ determines a desired pressure/density, $L_2$ may have determined the "pressure error" and adjusted intake manifold pressure up or down several times, taking account of fluctuations in intake manifold pressure and density. This relationship between the loop speed of $L_1$ and $L_2$ can accommodate rapidly changing intake manifold dynamics where engine speed is changing relatively more slowly.

$L_1$ will typically include determination of an engine speed or value indicative thereof, Box 124, from the combustion system of engine 10. Actual engine speed and rate of change in engine speed will be the result of such factors as the torque production of engine 11 and the internal inertia thereof. The determined engine speed value may then be compared with a desired engine speed value at a summer 112. The desired engine speed value or engine set point value used at summer 112 is represented with Box 137. A "speed error" value may thus be determined based on this comparison. The speed error value will then be used to determine a desired intake manifold pressure or desired intake manifold gas density, the determination being represented by Box 114.

The determined desired intake manifold pressure/density may be utilized at another summer 116, within $L_2$, to determine a value indicative of a difference between the desired intake manifold pressure and a determined intake manifold pressure value or "pressure error," from Box 122. At summer 116, the optional feed forward term from Box 110 is shown. Determination of the feed forward term may be a sub-routine of $L_1$, wherein a feed forward value is determined based on a load value, from Box 19, and a desired speed value, from Box 137.

Summer 116 may accordingly determine the value corresponding to the pressure error. The manifold pressure control, via throttle adjustment, takes place in Boxes 118, 120 and 122. Box 118 represents determination of a desired throttle position, based on the pressure error value determined at summer 116. Box 120 represents a throttle linearization calculation, which may be used to determine a throttle angle. Throttle linearization may allow adjustment of a throttle actuator to appear more linear in the control system, even though a linear change in intake manifold pressure may not necessarily be correlated with a linear change in throttle plate angle. Box 122 represents calculation of an intake manifold pressure value, which may in turn be used at summer 116.

INDUSTRIAL APPLICABILITY

It will generally be desirable to operate engine 11 at a speed that is as close as practicable to the predetermined engine speed set point, although in certain instances the engine speed set point may itself be adjusted. The engine speed set point may be selected based on a variety of factors. It is contemplated, however, that hardware concerns such as engine size, extent of turbocharging, and expected torque requirements, etc. will typically bear on a particular engine speed or speed range that will best integrate fuel efficiency, emissions and other variables, at least for a given torque demand or range of torque demands on engine 11. Even where little or no changes in the load on engine 11 are occurring, it may be desirable to continually monitor and adjust intake manifold pressure based on engine speed error. The relatively large number of interconnected components, each having multiple internal inertial and operating states, as well as changing ambient conditions may make speed control desirable even where engine 11 is operating under a relatively constant load. To this end, control loops $L_1$ and $L_2$ will typically run continuously, providing regular adjustments of engine speed by adjusting intake manifold pressure via adjustment of throttle position.

Due at least in part to turbocharging of engine 11 with turbocharger 16, increasing speed and load may not necessarily positively correlate with an increasingly open throttle, and decreasing speed and load may not necessarily positively correlate with a more closed throttle. In any event, however, during normal operation, $L_1$ will be monitoring engine speed error and determining the desired intake manifold pressure/density based at least in part thereon. $L_2$ will be controlling intake manifold pressure, for example, via adjustment of throttle position with throttle actuator 45. Where engine speed is too fast or too slow, the determined engine speed error value will be used to determine the desired intake manifold pressure or gas density, $L_1$. The determined desired pressure/density may in turn be used in $L_2$ as a basis for adjusting throttle position to adjust intake manifold pressure toward the desired pressure. By focusing on intake manifold pressure or density rather than throttle position, the present disclosure provides a more effective and precise means for controlling engine speed than in certain earlier designs.

Where apparatus 10 encounters a load change during normal operation, the load change may be initially detected with load sensor 19, and a corresponding signal may be sent to electronic controller 20. Electronic controller 20 may then incorporate the load change signal into the desired intake manifold pressure/density determination, $L_1$. Next, electronic controller 20 may determine the pressure error, and begin adjustment of throttle actuator 45 to adjust throttle position accordingly. In a typical scenario, the load change signal will be sent to electronic controller 20 and the resulting adjustment of throttle actuator 45 will take place in advance of any significant change in the speed of engine 11.

The control scheme described herein may thus include a true feed forward wherein control is resolved into a command proportional to torque, i.e. a desired intake manifold pressure or gas density. In many engines, including engine 11, the load, or required engine output torque will be proportional to the intake manifold pressure or gas density at a given air to fuel ratio. Thus, where an increased load is detected, the feed forward term from load sensor 19 may be directly incorporated into the desired intake manifold pressure or density determination of the first closed loop control algorithm. This capability represents an advantage over certain earlier control systems, wherein a throttle position was determined rather than a desired intake manifold pressure or density. In such earlier engines, it was challenging or impossible to accurately adjust throttle position based on a load feed forward term, as the relationship between load and throttle position needed to maintain that load is not always readily apparent. In contrast, operation according to the present disclosure allows true feed forward, taking advantage of the proportionality of load and intake manifold pressure or density. The use of feed forward in the present disclosure will be applicable to compensate for both dynamic disturbances such as transients, and commanded load changes.

The response of engine 11 to transients may also be faster than in a design wherein a conventional speed control loop responds to a speed error. This is due to the fact that pressure and density in the intake manifold are more closely and predictably related to engine load than throttle angle. Thus, response of the engine to adjustments of intake manifold pressure may be both faster and more reliable than adjustments of throttle angle without consideration or understanding of its effect on intake manifold pressure or density.

The present disclosure further provides a control system that is simpler in certain respects than many earlier designs. Conceptually, the "engine plant" may be thought of as having various internal states relating to the behavior of the turbocharger, intake and exhaust components, and the combustion system, which may be thought of as including states relating to torque production and engine inertia. All of the internal states of the engine plant may vary and, accordingly, response of the engine to changes in throttle position can be relatively slow and complex. Thus, in earlier single control loop designs wherein throttle position was adjusted based on an engine speed error value, response of the engine was in some instances too slow and complex to keep engine speed within a sufficiently narrow range for adequate performance.

In the present disclosure, rather than a single control loop attempting to integrate relatively slow and complex engine dynamics with relatively rapidly changing intake manifold dynamics, separate control loops are utilized with each of the separate control areas, providing for more rapid response than in earlier systems. In particular, because of the relationship between intake manifold pressure or density and the engine's output torque, adjustments in intake manifold pressure can more rapidly affect engine speed than relying on throttle position.

The present description is for illustrative purposes only, and should not be construed to narrow the breadth of the present disclosure in any fashion. Thus, those skilled in the art will appreciate that various modifications might be made to the presently disclosed embodiments without departing from the intended spirit and scope of the disclosure. For instance, engine 11 may include any of a variety of devices operable to determine values indicative of intake manifold pressure or gas density, and intake manifold temperature. Rather than a pressure sensor, engine 11 might be coupled with a massflow sensor, disposed upstream turbocharger 16 and operable to calculate or estimate a flow rate of gas to intake manifold 30. By estimating or calculating the mass of gas entering the known volume of intake manifold 30 per unit time, it is possible to determine a value indicative of intake manifold gas pressure or density. Other aspects, features and advantages will be apparent upon an examination of the attached drawing Figures and appended claims.

What is claimed is:

1. A method of operating an internal combustion engine comprising the steps of:

determining a value indicative of a difference between a desired engine speed and an actual engine speed;

determining at least one of, a desired intake manifold pressure and a desired intake manifold gas density, based at least in part on the determined value indicative of the difference between desired engine speed and actual engine speed;

determining a value indicative of an actual intake manifold pressure; and adjusting intake manifold pressure, based at least in part on the value indicative of actual intake manifold pressure, and the at least one of, desired intake manifold pressure and desired intake manifold gas density.

2. The method of claim 1 wherein the adjusting step comprises adjusting intake manifold pressure in the engine based at least in part on a difference between the value indicative of actual intake manifold pressure and the at least one of, desired intake manifold pressure and desired intake manifold gas density.

3. The method of claim 2 wherein the step of determining the value indicative of actual intake manifold pressure comprises determining said value at least in part with an electronic controller coupled with a pressure sensor disposed at least partially within an intake manifold of the engine.

4. The method of claim 3 wherein the step of determining the value indicative of actual intake manifold pressure comprises determining said value in part with a temperature sensor disposed at least partially within the intake manifold of the engine and coupled with the electronic controller.

5. The method of claim 3 wherein the adjusting step comprises adjusting an engine throttle position by sending a control signal from the electronic controller to a throttle actuator.

6. The method of claim 5 comprising the step of determining with the electronic controller a ratio of intake manifold pressure to intake manifold temperature;

wherein the adjusting step comprises adjusting the throttle position based at least in part on said ratio.

7. The method of claim 6 further comprising the step of determining an actual engine load;

wherein the step of determining the at least one of, desired intake manifold pressure and desired intake manifold gas density, comprises determining the at least one of, desired intake manifold pressure and desired intake manifold gas density, in conjunction with the actual engine load.

8. The method of claim 1 further comprising the step of determining an actual engine load;

wherein the step of determining the at least one of, desired intake manifold pressure and desired intake manifold gas density, comprises determining the at least one of, desired intake manifold pressure and desired intake manifold gas density, in conjunction with the actual engine load.

9. An article comprising:

a computer readable medium having a control algorithm recorded thereon, said control algorithm including:

a first closed loop control algorithm for determining at least one of, a desired intake manifold pressure and a desired intake manifold gas density in an internal combustion engine, based at least in part on a value indicative of a difference between a desired engine speed and an actual engine speed; and a second closed loop control algorithm for controlling a throttle position in said engine based at least in part on, said at least one of desired intake manifold pressure and desired intake manifold gas density, and a determined value indicative of an actual intake manifold pressure.

10. The article of claim 9 wherein said first control algorithm is a relatively slower loop algorithm, and said second control algorithm is a relatively faster loop algorithm.

11. The article of claim 10 wherein the first control algorithm includes a feed forward term based at least in part on a change in engine load.

12. The article of claim 11 wherein said second control algorithm controls throttle position in said engine, based at least in part on a desired intake manifold gas density and a determined value indicative of intake manifold gas density.

13. The article of claim 11 wherein said second control algorithm controls throttle position in said engine, based at least in part on a desired intake manifold pressure to temperature ratio, and a determined value indicative of the intake manifold pressure to temperature ratio.

14. An internal combustion engine comprising:

an electrical system that includes electronic controller with a control algorithm that includes:

a first closed loop control algorithm for determining at least one of, a desired intake manifold pressure and a desired intake manifold gas density in an internal combustion engine, based at least in part on a value indicative of a difference between a desired engine speed and an actual engine speed; and a second closed loop control algorithm for controlling a throttle position in said engine based at least in part on, said at least one of desired intake manifold pressure and desired intake manifold gas density, and a determined value indicative of an actual intake manifold pressure.

* * * * *